United States Patent [19]

Sprafke

[11] Patent Number: 4,587,880

[45] Date of Patent: May 13, 1986

[54] HATCH FOR A COMBAT VEHICLE, ESPECIALLY AN ARMORED VEHICLE

[75] Inventor: Uwe Sprafke, Schauenburg, Fed. Rep. of Germany

[73] Assignee: Wegmann & Co. GmbH, Kassel, Fed. Rep. of Germany

[21] Appl. No.: 544,141

[22] Filed: Oct. 21, 1983

[30] Foreign Application Priority Data

Oct. 21, 1982 [DE] Fed. Rep. of Germany ..... 3238885

[51] Int. Cl.[4] ..... F41H 5/22; F41F 9/04; B60J 7/00; E05D 15/58

[52] U.S. Cl. ..... 89/36.14; 49/41; 49/255; 49/385; 296/216; 89/36.08; 89/36.13

[58] Field of Search ..... 89/36 L, 36 K, 36 H, 89/36.08, 36.13, 36.14; 49/208, 385, 41, 255; 296/216

[56] References Cited

U.S. PATENT DOCUMENTS

| | | | |
|---|---|---|---|
| 2,454,268 | 11/1948 | Brackett | 89/36.14 X |
| 2,898,810 | 8/1959 | Even | 89/36.08 |
| 3,355,987 | 12/1967 | Kunze | 89/36.08 |
| 3,589,069 | 6/1971 | Lecomte | 49/41.01 |
| 3,975,048 | 8/1976 | Matusek | 296/216 |
| 4,004,494 | 1/1977 | Mechulam et al. | 89/36.14 |
| 4,092,901 | 6/1978 | Gustavsson et al. | 89/36.14 |
| 4,144,797 | 3/1979 | Berge et al. | 89/36.13 |
| 4,159,669 | 7/1979 | Jackson et al. | 89/36.14 |

FOREIGN PATENT DOCUMENTS

| | | | |
|---|---|---|---|
| 557908 | 12/1943 | United Kingdom | 89/36.08 |

*Primary Examiner*—David H. Brown

*Attorney, Agent, or Firm*—Sprung, Horn, Kramer & Woods

[57] ABSTRACT

A combat vehicle, especially an armored vehicle, with a rotating turret on a hull and with an entry-and-exit hatch that can be closed with a cover and that is mounted in the roof of the hull. The parts of the roof of the hull in the vicinity of the hatch consist of a circular plate that rotates on an axis perpendicular to the roof and in which the hatch is positioned in the plate eccentric to its axis of rotation. To make the hatch as small as possible, while permitting exit from the vehicle at all turret positions, the position of the hatch can be varied.

7 Claims, 7 Drawing Figures

FIG. 4
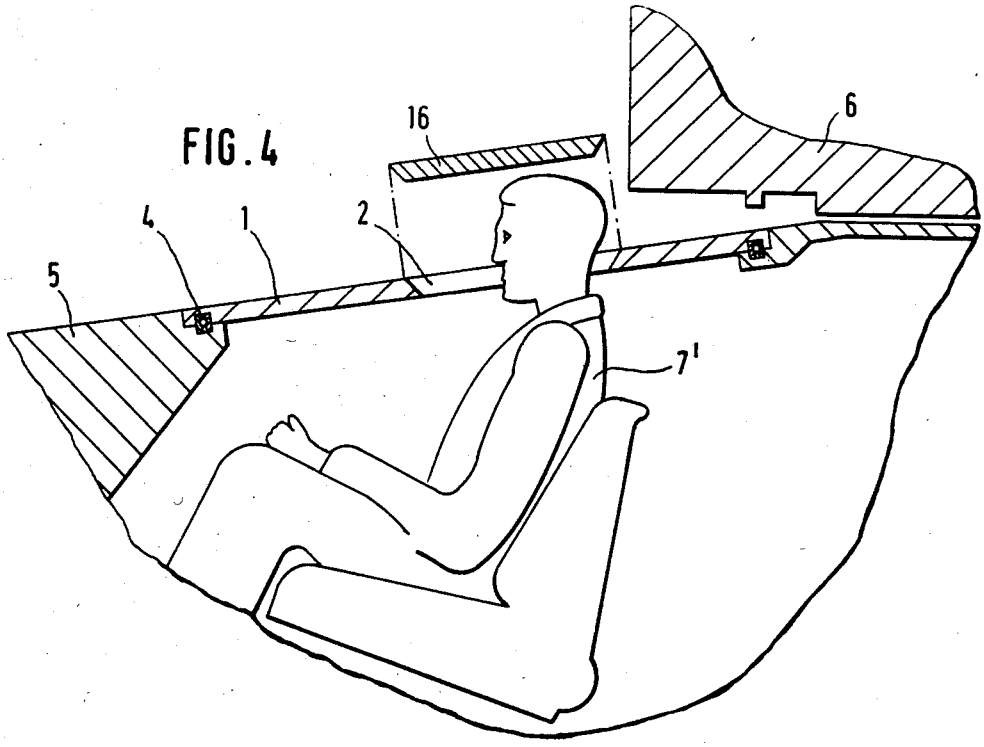
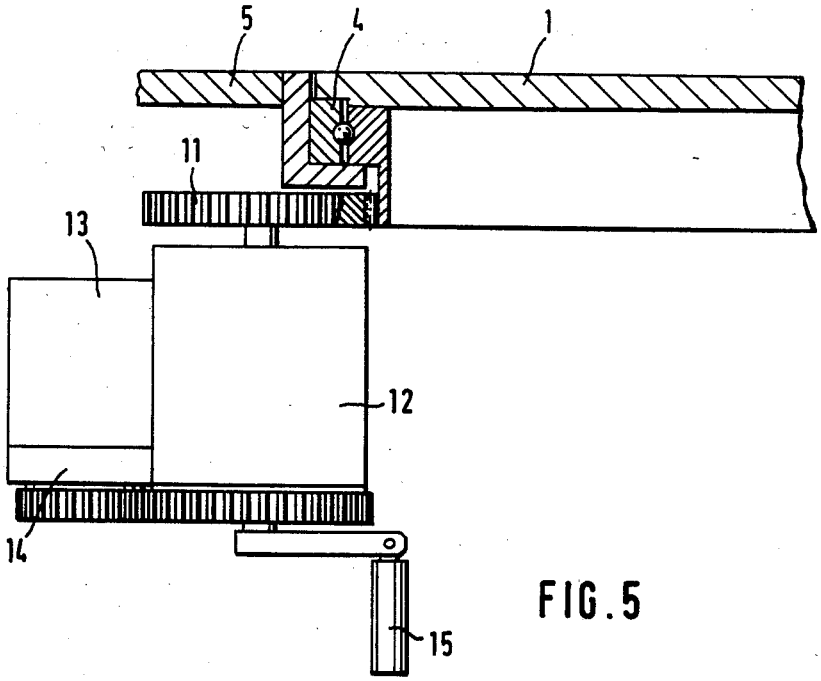
FIG. 5

HATCH FOR A COMBAT VEHICLE, ESPECIALLY AN ARMORED VEHICLE

BACKGROUND OF THE INVENTION

The present invention relates to a combat vehicle, especially an armored vehicle, with a rotating turret on a hull and with an entry-and-exit hatch that can be closed with a cover and that is mounted in the roof of the hull.

The covered entry-and-exit hatch on known turreted combat vehicles has been positioned, along with the devices that provide the driver with a view of the exterior environment, outside the area within which the turret rotates.

Reinforcing the armor in both the hull and the turret has made it necessary to displace the hatch to where it is at least to some extent within the area occupied by the turret. The result is that, when the hatch is opened, the cover must somehow be conveniently shifted out of that area.

Another problem derives from the positioning of the viewing devices, which are usually periscopes. The viewing devices in the first type of aforesaid known combat vehicles could be positioned in front of the hatch. Since, however, the driver's seat in later models was very far to the rear, the viewing devices had to be positioned behind the hatch to ensure satisfactory visibility, which, however, made it difficult to enter and exit from the vehicle. To eliminate this problem, then, the viewing devices had to be shifted out of the driver's way.

These problems lead to the partial integration of the viewing devices into the hatch cover, which had to designed to lift and pivot or lift and slide. The drawback to this solution was that it required a large hatch and hence a large hatch cover with a lot of weight to be shifted. The cover opening and closing mechanisms became complicated. Another disadvantage is that the circumference of the hatch, which must be sealed off, was longer.

The most difficult problem involved in these known designs, however, was the location of the viewing devices. The given hatch design, the extent of free space between the hull and the turret, and the limited potential for accommodating the devices in the hatch lead to unsatisfactory visibility. Spatial relationships allow the viewing devices to be displaced or rotated only within the available planes. Although the devices could be positioned out of the driver's way only be displacing them toward the center, the given geometry would not allow this.

SUMMARY OF THE INVENTION

The main object of the present invention is to provide a combat vehicle of the aforesaid type in which the entry-and-exit hatch is positioned and designed to allow entry and exit at every position of the turret and in which the viewing devices can be positioned where they will not impede entry and exit while ensuring satisfactory visibility during operation.

This object is attained in accordance with the invention with a combat vehicle in which the parts of the roof of the hull in the vicinity of the hatch consist of a circular plate that rotates on an axis perpendicular to the roof and in which the hatch is positioned in the plate eccentric to its axis of rotation.

The rotatable plate is mounted in a race gear with sealing means. Moreover, at least some of the viewing devices associated with the driver's seat are preferably mounted on the rotating plate. Preferably, the viewing devices are positioned essentially opposite each other on the plate in relation to its axis of rotation.

The hatch cover preferably can be lifted into a partly open position and then swung or shifted into a completely open position. When the cover swings, the axis on which it pivots is preferably at the edge of the rotating plate. The hatch is preferably shaped essentially like a rounded triangle and is positioned in the rotating plate with one apex in the vicinity of the circumference of the plate and another apex near the axis of rotation. The hatch and the rotating plate are preferably positioned so that the hatch arrives at a particular driver's operating position when the plate rotates before entering the area covered by the turret.

Locating the hatch in a rotating plate mounted in the roof of the hull allows the driver to rotate the plate to bring the hatch into reach and into a convenient exit position. When at least some of the viewing devices are also located on the rotating plate, the driver can also rotate it to get them out of his way.

Although the plate is relatively heavy, it does not require lifting or pivoting mechanisms because it can be moved in one plane. This considerably facilitates operations.

The hatch is as small as human-engineering principles will allow in order to decrease the circumference that has to be sealed off, increase the tightness of the hatch, and reduce the weight of the cover. The cover can be opened and closed with any appropriate known low-cost mechanism.

To exploit still another advantage of the rotating plate the cover can be designed to be lifted into a partly open position and then swung or shifted into a completely open position.

In summary, the advantages obtainable with a hatch in accordance with the invention are that (a) a wide range of known hatch designs can be employed, (b) a wide range of known models of viewing device can be employed, (c) other specialized components can be mounted on the rotating plate within reach of the driver, (d) the hatches can be as small as possible and hence the weight to be shifted as low as possible, (e) hatch tightness can be increased, (f) operating the opening-and-closing mechanism can be extensively simplified, (g) visibility can be improved, and (h) emergency-exit capabilities can be provided when for example the turret itself does not rotate, and emergency access from outside can be ensured.

One preferred embodiment of a combat vehicle in accordance with the invention will now be described with reference to the attached drawings which illustrate only the vicinity of the entry-and-exit hatch and the details essential to the invention, and wherein:

DETAILED DESCRIPTION OF THE PREFERRED EMBODIMENTS

Figure 1:
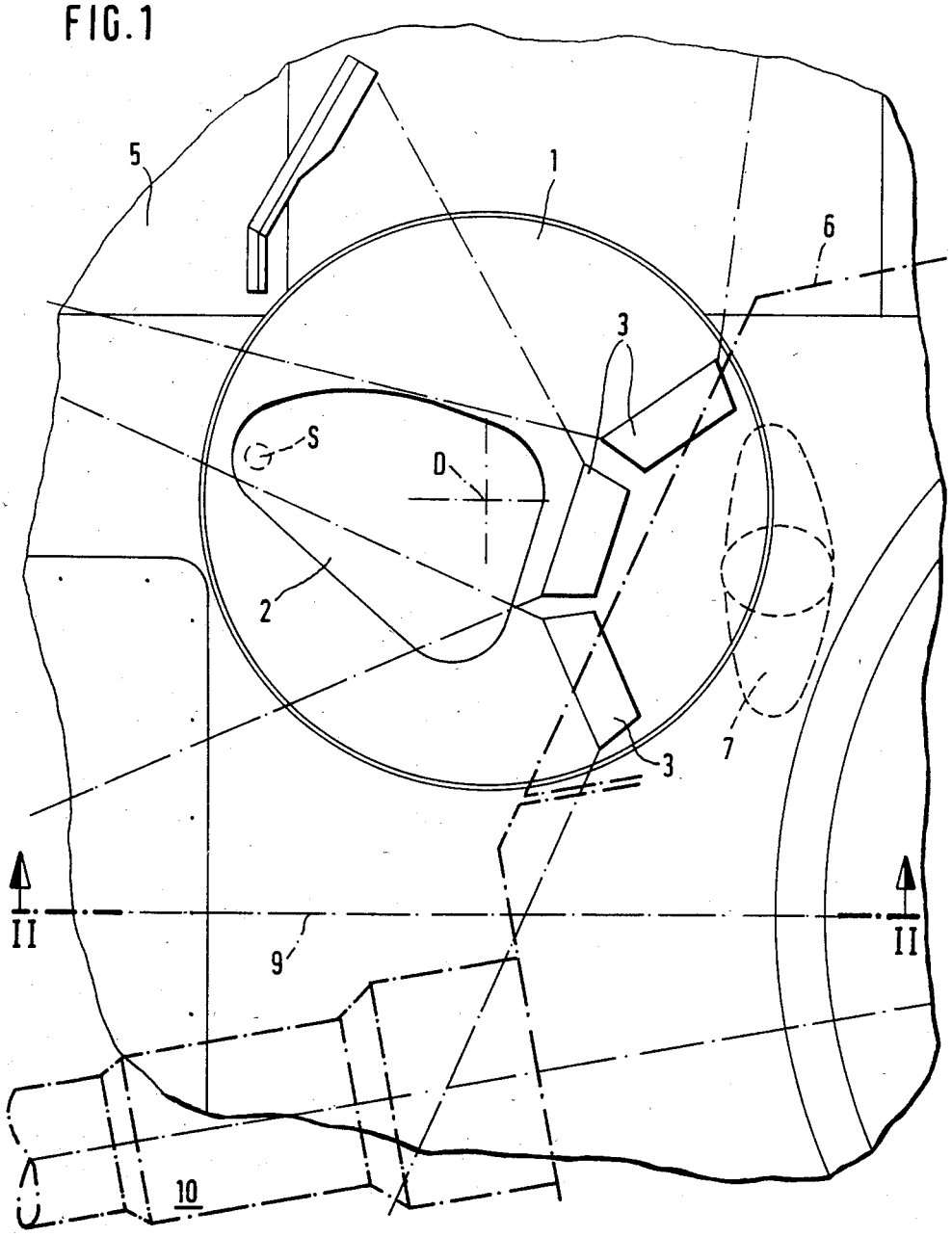
FIG. 1 is a top view of the hull of an armored combat vehicle in accordance with the present invention in the vicinity of the hatch with the rotating plate in one particular position, FIG. 2 a section along the line II—II in FIG. 1, FIG. 3 a view from the same aspect in FIG. 1 with the rotating plate in a different position, FIG. 4 a section along the line IV—IV in FIG. 3, FIG. 5 a mechanism for powering the rotating plate in accordance with the invention.
Figure 2:
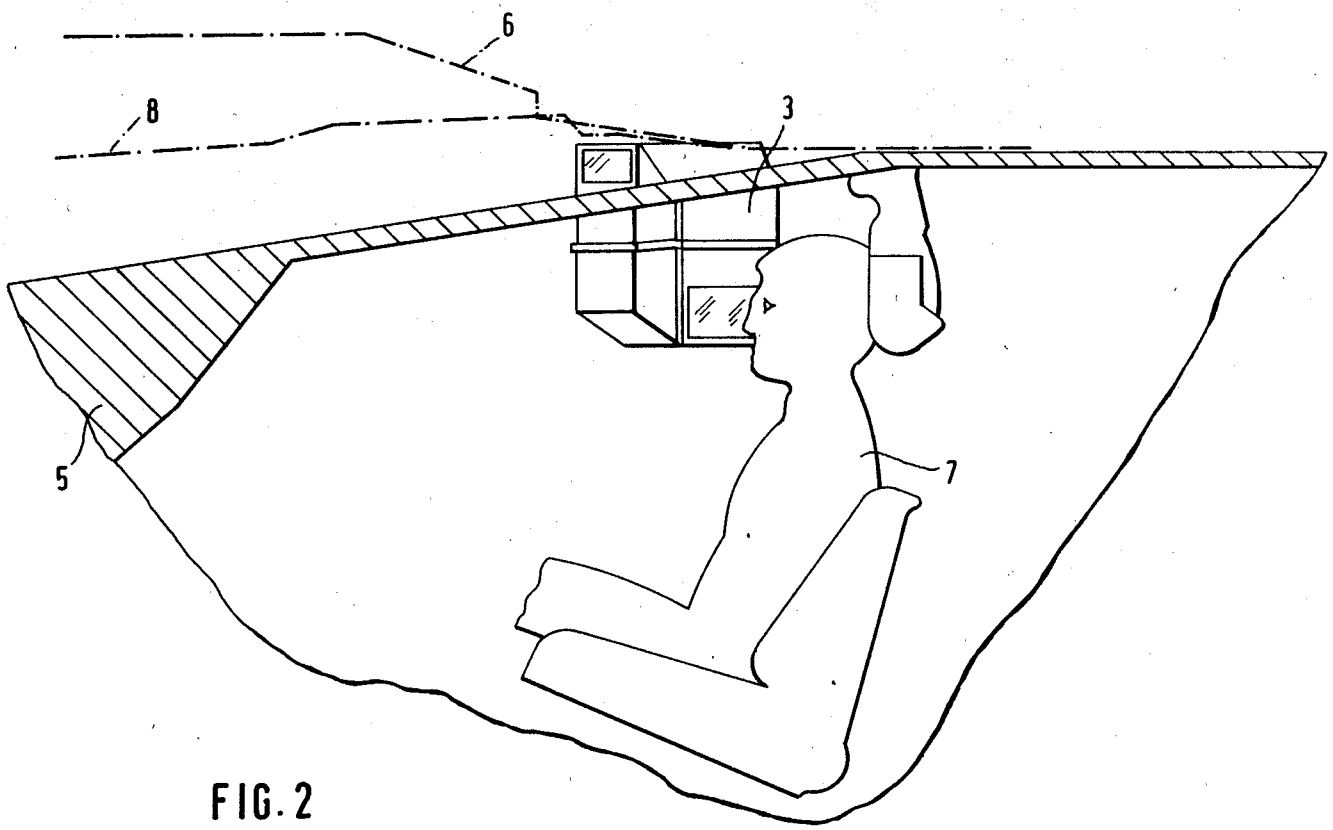

As will be evident from FIGS. 1–5, a circular plate 1 that rotates around an axis D is set into the roof of the hull 5 of an armored combat vehicle. Rotatable plate 1 is connected to the roof by known methods by means of a sealed race gear 4. Plate 1 can be rotated as illustrated in FIG. 5 with either a manually operated or a motorized mechanism for example. Race gear 4 is accordingly engaged by a pinion 11 that is powered through a gear 12, a planetary gear for example, by an electric motor 13 connected to the gear by a coupling 14. A manually operated crank 15 has also been provided to rotate the plate into the desired position in case of motor failure.

Figure 6:
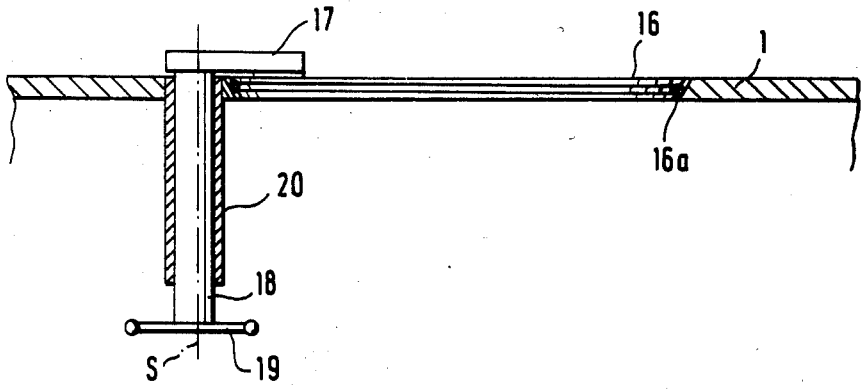
FIG. 6 is an enlarged section from FIG. 4 with the hatch cover closed.
Figure 7:
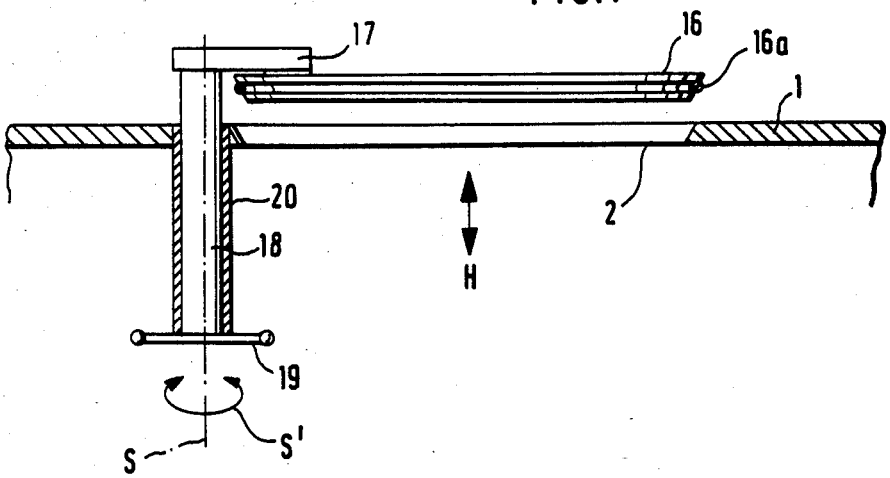
FIG. 7 is similar to FIG. 6 but with the hatch cover partly open.

A hatch 2 is positioned in rotating plate 1 eccentric to its axis D of rotation. As will be evident from FIGS. 1 and 3, hatch 2, which is designed in accordance with the principles of human engineering, is shaped essentially like a rounded triangle. It is positioned in rotating plate 1 with one apex 2*a* in the vicinity of the circumference of the plate and another apex 2*b* near axis D of rotation. Hatch cover 16 is positioned in such a way that it can be lifted and in the lifted state swung out on a pivot axis S in the vicinity of the edge of the cover at one corner 2*a* of the triangle. Hatch cover 16 is accordingly displaced, as will be evident from FIGS. 6 and 7, in two steps. In the first step it is lifted, by a lifting-and-pivoting mechanism from the closed position illustrated in FIG. 6 into the position illustrated in FIG. 7 in the direction indicated by arrow H, high enough to be pivoted in the second step around axis S in the direction indicated by arrow S'. The lifting-and-pivoting mechanism has a lifting shaft 18 that is connected by an arm 17 to hatch cover 16. There is a handle 19 at the bottom of shaft 18. Shaft 18 can be lifted through and rotated in a lifting tube 20 that is rigidly connected to rotating plate 1. The edge of hatch cover 16 has a seal 16*a* that rests against the inner edge of hatch 2 when the hatch is closed, providing a sealed closure.

The lifting-and-pivoting mechanism can also be long enough to lift hatch cover 16 into a third position as illustrated in FIG. 4 in which the vehicle can be driven and protected from shrapnel.

There are also viewing devices 3, periscopes for example, in rotating plate 1, specifically at a point adjacent the axis D of rotation of hatch 2.

Figure 3:
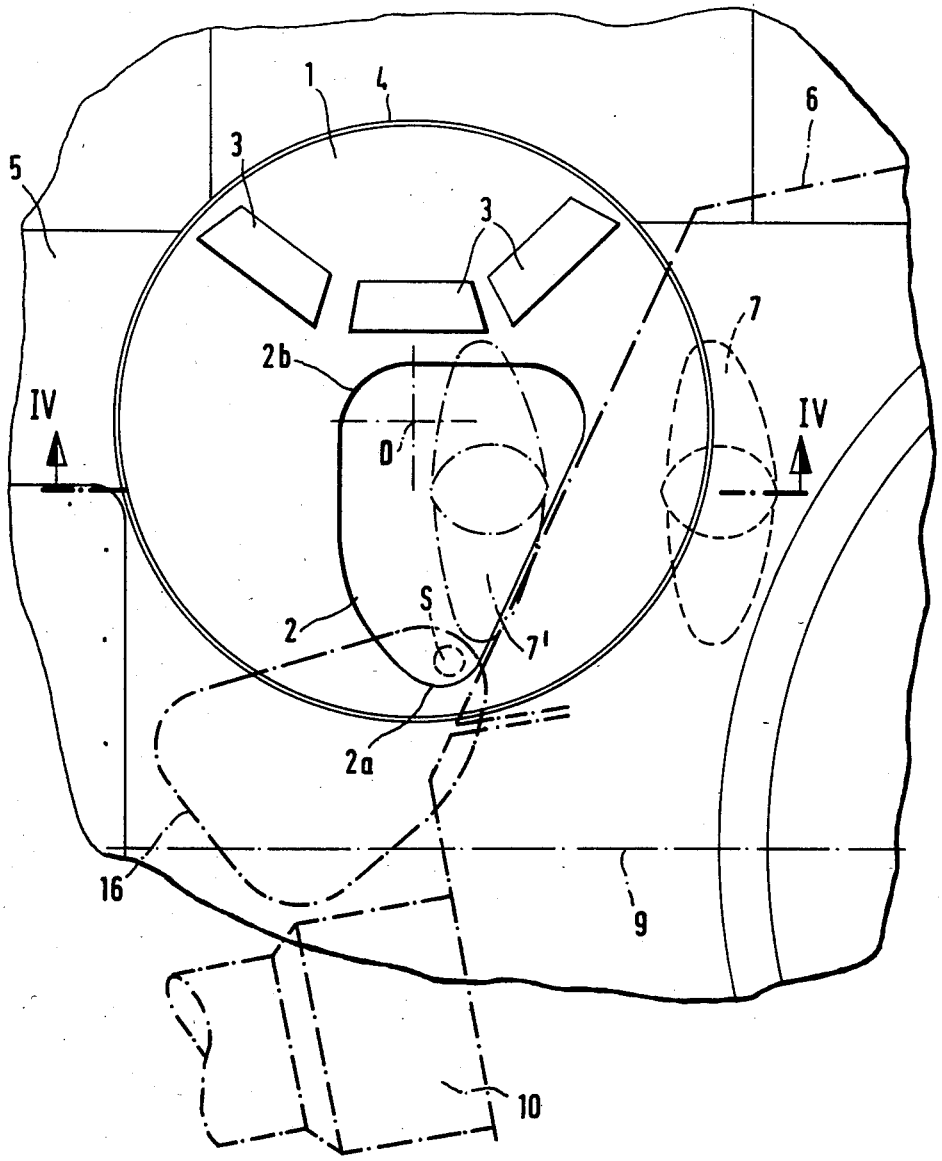

The turret 6 and weapon 10 of the armored vehicle and the longitudinal midline 9 of the hull are indicated in FIGS. 1 and 3 with dot-and-dash lines.

FIG. 1 illustrates rotating plate 1 in the position in which the armored combat vehicle is being driven with the hatch closed. The driver sits relatively far back in a position 7 covered by turret 6 and his range of vision is determined by viewing devices 3. This situation will also be evident from FIG. 2. If the driver wants to get out or continue driving with the hatch cover up and with direct visibility, he pivots plate 1 into the position illustrated in FIG. 3. This rotation of approximately 110° shifts viewing devices 3 out of the driver's way and hatch 2 into his reach. The viewing devices have, in the position illustrated in FIG. 3, been moved out of the area covered by turret 6, whereas the hatch has not yet moved into that area. The driver can, from a somewhat advanced position 7', lift hatch cover 16 and, as illustrated in FIG. 4, drive the vehicle with somewhat restricted vision. In this position of the cover he will be protected from shrapnel and from rain and snow.

If the driver wants to get out, the lifted cover 16 is swung out on pivot axis S into the position indicated with the dot-and-dash line in FIG. 3, upon which he can climb out through the hatch from advanced position 7'.

It will also be evident from the illustrated embodiment that the hatch can always be employed as an emergency exit no matter what position the turret is in. Even when weapon 10 has been lowered, into the position 8 illustrated in FIG. 2 for instance, it is still always possible to rotate plate 1 to bring hatch 2 into a position in which it is possible to climb out. Appropriate means of emergency access, with plate 1 being rotated and hatch cover 16 opened from outside can also be provided.

It will be appreciated that the instant specification and claims are set forth by way of illustration and not limitation, and that various modifications and changes may be made without departing from the spirit and scope of the present invention.

What is claimed is:

1. In a combat vehicle with a rotating turret on a hull, a driver's operating position in the hull and means forming an entry-and-exit hatch in the roof of the hull in the vicinity of the driver's operating position with a cover for closing the hatch, the improvement wherein the hatch forming means comprises a circular plate in the roof of the hull and means mounting the circular plate for rotation about an axis perpendicular to the roof and wherein the hatch is disposed in the circular plate eccentric to the axis of rotation of the plate and further comprising at least one viewing device mounted on the rotatable plate for viewing from the driver's operating position and wherein the hatch and the at least one viewing device are positioned substantially opposite each other on the plate relative to the axis of rotation of the plate.

2. The combat vehicle as in claim 1, wherein the means mounting the plate comprises a sealed race gear.

3. The combat vehicle as in claim 1, wherein the hatch is shaped essentially like a rounded triangle and is positioned in the rotating plate with one apex in the vicinity of the circumference of the plate and another apex near the axis of rotation.

4. The combat vehicle as in claim 1, wherein the turret covers an area of the plate and wherein the hatch and the rotatable plate are positioned so that the hatch arrives at the driver's operating position when the plate rotates before entering the area covered by the turret.

5. The combat vehicle according to claim 1, wherein the circular plate is horizontal and the axis of rotation thereof is vertical.

6. The combat vehicle as in claim 1, further comprising means mounting the cover to the plate to permit the lifting thereof into a partly open position and thereafter the swinging into a completely open position.

7. The combat vehicle as in claim 6, wherein, when the cover swings, its pivot axis is disposed at the edge of the rotatable plate.

* * * * *